US010478696B2

(12) United States Patent
Yablonowski et al.

(10) Patent No.: US 10,478,696 B2
(45) Date of Patent: Nov. 19, 2019

(54) REHABILITATION EXERCISE DEVICE

(71) Applicant: CPY 2 LLC, Naples, FL (US)

(72) Inventors: Cindy Yablonowski, Naples, FL (US); Randall Yablonowski, Plainfield, IN (US); James Yablonowski, Cedar Lake, IN (US); Robert J. Marsh, II, Naples, FL (US); John L. Smelser, Sarasota, FL (US)

(73) Assignee: CPY 2 LLC, Naples, FL (US)

( * ) Notice: Subject to any disclaimer, the term of this patent is extended or adjusted under 35 U.S.C. 154(b) by 0 days.

(21) Appl. No.: 16/179,068

(22) Filed: Nov. 2, 2018

(65) Prior Publication Data

US 2019/0060730 A1 Feb. 28, 2019

Related U.S. Application Data

(63) Continuation-in-part of application No. 15/683,311, filed on Aug. 22, 2017, now Pat. No. 10,155,147.

(51) Int. Cl.

| | |
|---|---|
| ***A63B 69/00*** | (2006.01) |
| ***A63B 69/38*** | (2006.01) |
| ***A63B 59/50*** | (2015.01) |
| ***A63B 69/36*** | (2006.01) |
| ***A63B 1/00*** | (2006.01) |

(52) U.S. Cl.

CPC ..... *A63B 69/0002* (2013.01); *A63B 1/00* (2013.01); *A63B 59/50* (2015.10); *A63B 69/3632* (2013.01); *A63B 69/38* (2013.01); *A63B 2069/0008* (2013.01)

(58) Field of Classification Search

CPC ..... A63B 69/00; A63B 59/40; A63B 69/36

See application file for complete search history.

(56) References Cited

U.S. PATENT DOCUMENTS

| | | | | |
|---|---|---|---|---|
| 2,819,081 A * | 1/1958 | Touraine | ..... | A63B 21/0618 482/119 |
| 5,335,918 A * | 8/1994 | Rupnik | ..... | A63B 24/0003 473/228 |
| 9,636,560 B1 * | 5/2017 | Celone | ..... | A63B 69/0002 |

* cited by examiner

*Primary Examiner* — Eugene L Kim
*Assistant Examiner* — Christopher Glenn
(74) *Attorney, Agent, or Firm* — Smith & Hopen, P.A.; Paul Murty

(57) ABSTRACT

A sports training device attached to the shaft of a swinging sports apparatus, such as a baseball bat. The device includes a drag chute disposed between two rigid members, a support rod disposed between the two rigid members along the longitudinal axis of the chute, and a plurality of coupling elements connected to the support rod. Each coupling element includes an annular opening for positioning of the sports apparatus therethrough. One coupling element has a stationary component that secures the device to the sports apparatus and a rotating component that rotates 360° around the sports apparatus. As such, the entirety of the device, with exception to this stationary component, can substantially freely rotate 360° around the sports apparatus. Resistance during a swing can be adjusted by sliding the coupling mechanisms along the support rod to expose more or less of the chute.

17 Claims, 16 Drawing Sheets

REHABILITATION EXERCISE DEVICE

RELATED PATENT

This nonprovisional application is a continuation-in-part of and claims priority to nonprovisional application Ser. No. 15/683,311, entitled "Baseball Training Apparatus," filed on Aug. 22, 2017, by the same inventors.

BACKGROUND OF THE INVENTION

1. Field of the Invention

This invention relates, generally, to sports exercise equipment. More specifically, it relates to a device that exercises muscles and improves performance in sports that require swinging an apparatus, e.g., club, bat, stick, or racket.

2. Brief Description of the Prior Art

Sports training devices are known in the art for aiding in the swinging motion of a piece of sporting equipment, such as a baseball bat. However, they fail to teach or suggest a mechanism that allows the full range of motion without becoming entangled around the shaft of the club, bat, stick, or racket.

One such device is U.S. Pat. No. 5,335,918 to Rupnik et al. This device teaches an attachment to a golf club that only provides air resistance when the club is swung incorrectly. This device attempts to eliminate the slice in a golf swing. Also, the air foil in this invention is made of a stiff material and therefore does not freely move about the shaft based on a user's unique swing.

A previous patent obtained by the current applicant (U.S. Pat. No. 8,202,204 to Celone et al.) teaches an apparatus that is attached by coupling links affixed to the shaft of the club. It also alleges 360° motion about the shaft; however, the device could become entangled around the shaft of the club, bat, stick, or racket, due to the ends of the drag chute being capable of rotating at different speeds, independent of each other.

U.S. Pat. No. 7,384,344 to Aguirre teaches an apparatus that includes a drag chute that is filled with air and kept from becoming entangled by its booms and is attached to a shaft by boom mounts. However, the device in Aguirre does not attach to the club, bat, stick, or racket. Therefore, a user cannot practice hitting the ball as in golf, baseball and tennis, or hit the puck in hockey. This is a serious drawback if the user's goal is to train for a specific sport. Further, the mechanism by which the drag chute couples to the club appears to be quite complex, but it functions for its own purpose sine a user cannot remove the training device from the club; rather, it is manufactured to be affixed on the club, thus permitting a greater flexibility for how the training device can be structured.

Another patent obtained by the applicant (U.S. Pat. No. 9,636,560 to Thomas J. Celone et al.) teaches an apparatus that couples to a bat's shaft and allows a full, 360° range of motion around the shaft. However, though quite effective, this device can be deemed slightly bulky (with certain embodiments having multiple rods therein) and permits only one resistance level (e.g., max resistance) when swinging the bat. Thus, the device may only be suited for certain users.

Collectively, previous devices have allowed for 360° motion; however, these devices must utilize a static air foil or risk becoming entangled around the shaft of the club, bat, stick, or racket, and they only offer a single level of resistance.

Moreover, rehabilitation devices are known in the art for improving muscle strength, rotation, and flexibility. Such rehabilitation devices are often used in the aftermath of an injury or other debilitation, such as a broken bone or a pulled muscle. For example, a patient recovering from a broken clavicle may require rehabilitation of the shoulder, arm, and hand, and the related muscles and nerves thereof. Such a patient typically performs rehabilitation exercises using a flexible band made of rubber designed to be wrapped around a secure structure, such as a wall, door, doorknob, or the patient's foot. Alternatively, the flexible band may be formed from another deformable material that is capable of providing resistance when stretched, so long as the material is designed to rebound to a position of repose when no longer receiving a force. The patient rebuilds arm strength and mobility by stretching the band and overcoming the resistance offered by the secure structure. While such devices are useful in rehabilitation applications, they are cumbersome in use and typically require an external structure to provide an adequate platform for the rehabilitation exercises. Moreover, since such devices are made from rubber or other deformable, elastic materials, the devices are prone to breaking upon receiving too great of a force from the user, which can be dangerous to the user if the bands snap during an exercise. The user can fall and experience a reinjury or a new injury as a result of the snapped band.

Accordingly, what is needed is an easily-grippable rehabilitation device that provides a full, 360° range of motion around the handle of the device, and provides an adjustable air resistance for rehabilitation, regardless of strength level or the patient's need. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a sports exercise device that provides adjustable swing resistance is now met by a new, useful, and nonobvious invention.

In an embodiment, the current invention is a training apparatus for attaching to a shaft of a swinging sports apparatus (e.g., baseball bat). The training apparatus includes a drag chute having a proximal lateral edge, a distal lateral edge, and a longitudinal axis between the proximal lateral edge and the distal lateral edge. A proximal rigid member is disposed along the proximal lateral edge of the drag chute (e.g., coupled using snap buttons), and a distal rigid member is disposed along the distal lateral edge of the drag chute (e.g., coupled using snap buttons). These rigid members maintain alignment of the drag chute and prevent twisting of the drag chute during a swing of the sports apparatus. One or more support rods are disposed along the longitudinal axis of the drag chute, where the support rod has a proximal end secured at the proximal rigid member and a distal end secured at the distal rigid member. This support rod provides stability to the chute during a swing of the sports apparatus.

A proximal coupling element is coupled to the support rod and has an inner aperture, where the proximal coupling element includes a stationary component (e.g., inner bearing, optionally with an O-ring disposed therewithin) and a rotating component (e.g., outer bearing). The stationary component is secured and stationary around a first portion of the shaft of the sports apparatus. The rotating component substantially freely rotates 360° around the first portion of the shaft, while the stationary component remains stationary there. The stationary component has an inner diameter that is smaller than the diameter of the first portion of the shaft around which the stationary component is positioned, so that the stationary component is immovably secured around the first portion of the shaft of the sports apparatus. In certain embodiments, the rotating component is positioned around the stationary component and rotates around the stationary component and also around the shaft of the sports apparatus. In this case, the inner diameter of the rotating component is larger than an inner diameter of the stationary component, such that the stationary component is prevented from slipping out of the rotating component. Optionally, the rotating component can be formed of two halves that have a hinged connection and are configured to be opened, so that the inner stationary component can be accessed upon opening the outer rotating component.

The training apparatus further includes a distal coupling element, which is also coupled to the support rod and has an inner aperture, where the distal proximal coupling element is disposed around a second portion of the shaft of the sports apparatus. This second portion of the shaft is distal to the first portion. At least a portion of the distal coupling component substantially freely rotates 360° around the second portion of the shaft.

In this configuration, the drag chute, the proximal rigid member, the distal rigid member, the support rod, the rotating component of the proximal coupling element, and at least a portion of the distal coupling element collectively substantially freely rotate 360° around the shaft of the swinging sports apparatus in synchronization with each other.

When the swinging sports apparatus is a bat (baseball, softball, wiffle ball, etc.), the inner diameter of the stationary component is smaller than the largest diameter of the bat, and the inner diameter of the distal coupling element is larger than the largest diameter of the bat. In this way, the stationary component can be secured to the bat as the bat slides through its inner aperture, and the distal coupling element can freely rotate around the bat regardless of position.

In certain embodiments, the coupling elements can each include a support rod channel, and the support rod extends through the support rod channels of the coupling elements. The coupling elements can be slidable along the support rod. To prevent sliding during a swing of the sports apparatus, the training apparatus can include a locking mechanism (e.g., adjustment bolt) in communication with the support rod and in further communication with the proximal coupling element and/or the distal coupling element (e.g., disposed through the distal coupling mechanism). The locking mechanism has a locked position and an unlocked position. In the locked position, the proximal coupling element and/or the distal coupling element are locked in place along the longitudinal axis of the support rod. In the unlocked position, the proximal coupling element and/or the distal coupling element can slide along the longitudinal axis of the support rod. In addition, a stability bar may be secured between the coupling elements for maintaining a constant spaced distance between them.

In a separate embodiment, the current invention is a swinging sports exercise and training device for attaching to a shaft of a sports apparatus, where the device includes any one or more—or even all—of the foregoing characteristics and features.

In another embodiment, the current invention is a swinging and/or rotating rehabilitation apparatus to which a user's limb can be secured, such that the user can swing, rotate, or otherwise move the rehabilitation apparatus to perform exercises. The rehabilitation apparatus includes a proximal end opposite a distal end, with a proximal rigid member disposed at the proximal end, and a distal rigid member disposed at the distal end. A drag chute spans from the proximal end to the distal end and is coupled to each of the proximal rigid member and the distal rigid member. A support rod is also secured to each of the proximal rigid member and the distal rigid member, such that the support rod spans along a longitudinal axis of the drag chute.

The rehabilitation apparatus also includes a proximal coupling element coupled to the support rod and disposed adjacent to the proximal rigid member. The proximal coupling element defines an aperture through which a user's limb can be inserted. Moreover, the rehabilitation apparatus includes a distal coupling element coupled to the support rod and disposed between the proximal coupling element and the distal end of the rehabilitation apparatus. The distal coupling element includes an outer housing defining an aperture, and a handle coupled to and disposed interior of the outer housing. In use, a user can insert his or her limb through the aperture of the proximal coupling element to grasp the handle of the distal coupling element. The user can then either swing the rehabilitation apparatus while grasping the handle, or rotate the rehabilitation apparatus if the handle is free to rotate within an outer housing of the distal coupling element.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
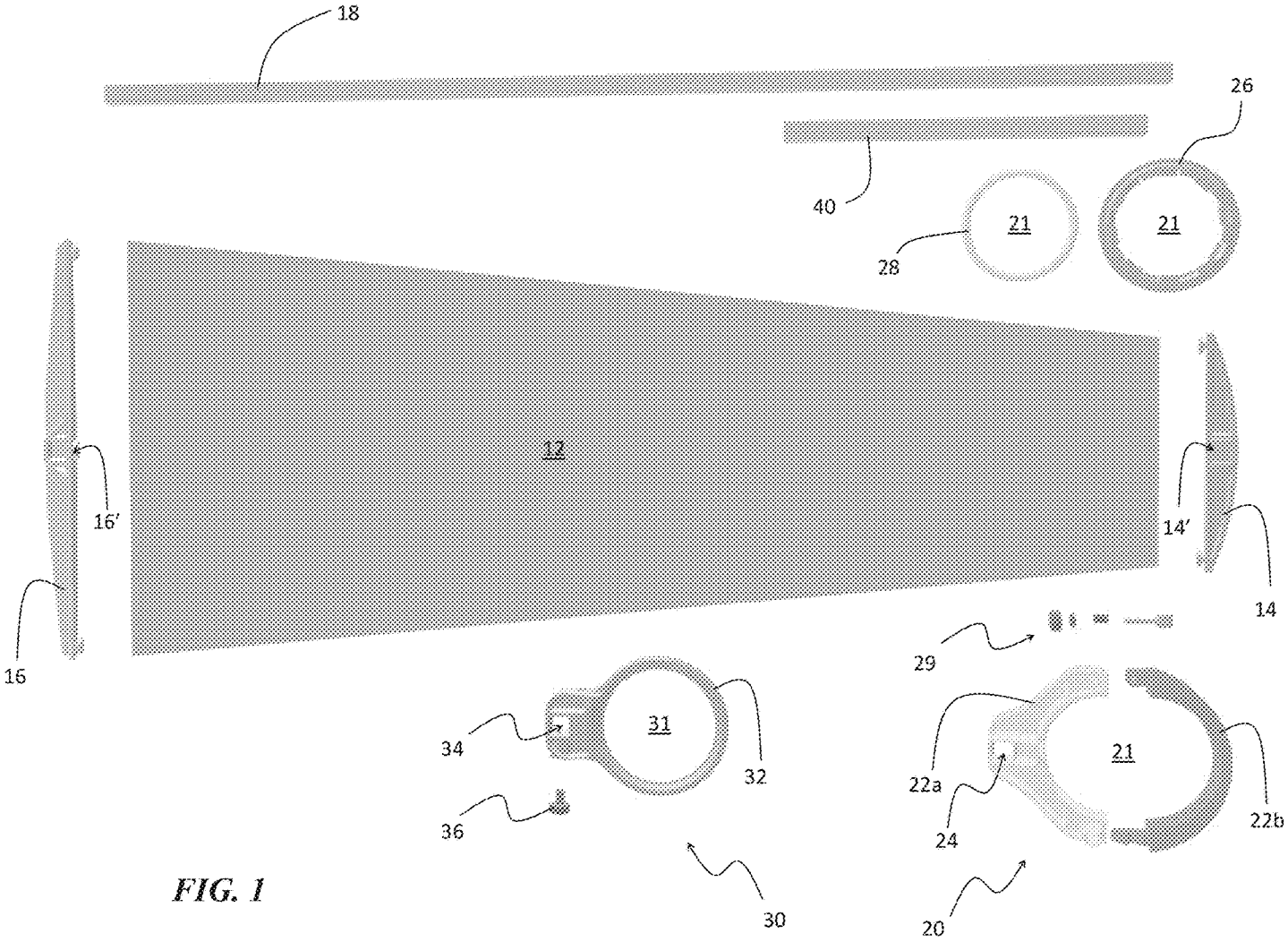
FIG. 1 is an exploded view of a sports swinging exercise and training apparatus, according to an embodiment of the current invention.
Figure 2:
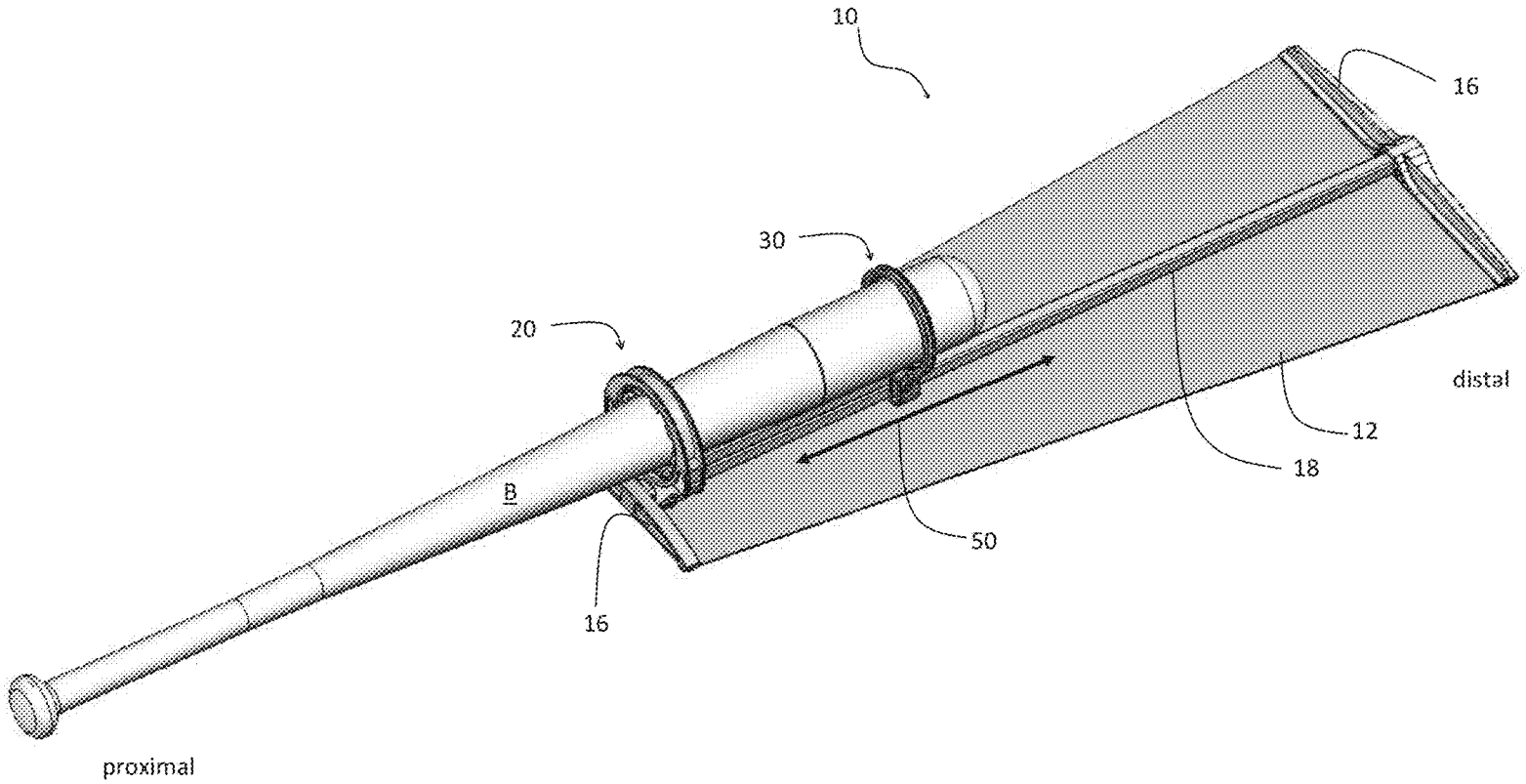
FIG. 2 is a perspective view of a sports swinging exercise and training apparatus, according to an embodiment of the current invention.
Figure 3:
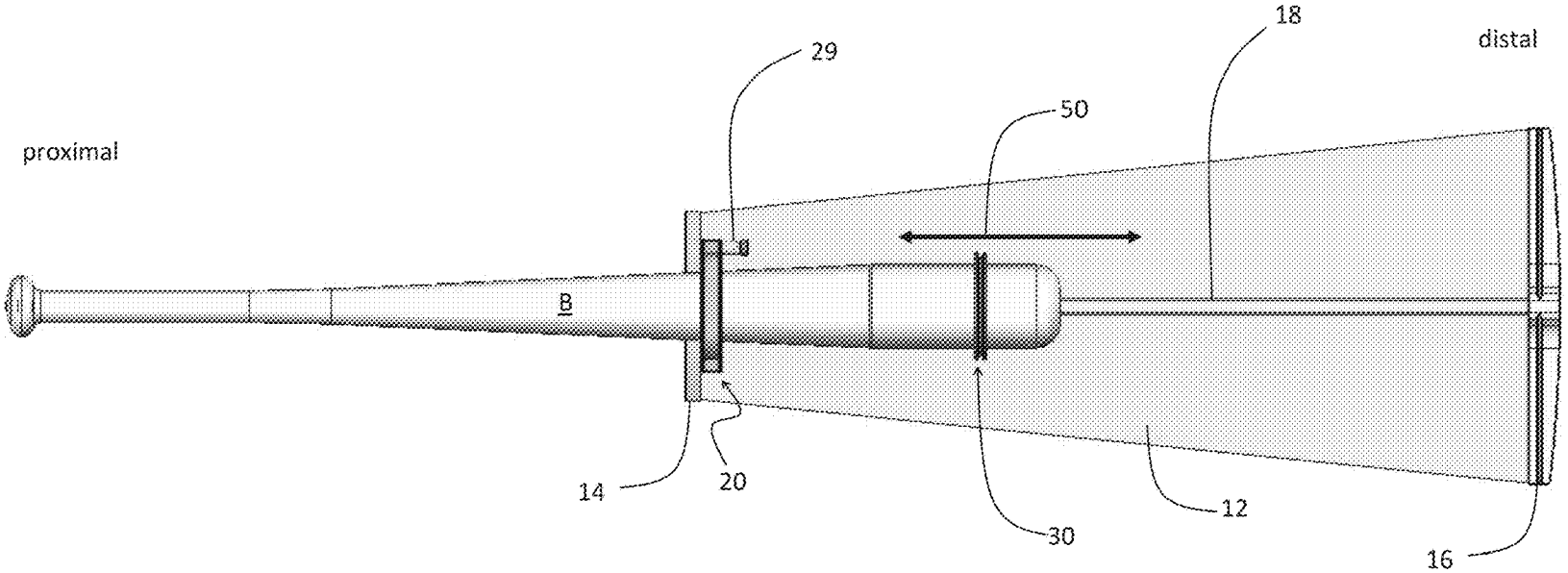
FIG. 3 is a front elevated view of a sports swinging exercise and training apparatus, according to an embodiment of the current invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

In certain embodiments, the current invention is a swinging sports exercise and training device designed for attachment to the shaft of a swinging sports apparatus, such as a bat (baseball, softball, wiffle ball, etc.). An example of the invention will be described and illustrated herein as applied to a baseball bat, but it can be understood how the device can be applied to other swinging sports apparatuses as well. For example, in alternative embodiments, the current invention is a rehabilitation exercise device designed for a user to grasp a portion of the device and swing the device to gain/regain strength and movement, such as arm muscle strength and shoulder movement.

The swinging sports exercise and training device has two connection points (proximal and distal connection points) on the bat and slides over the handle of the bat until both connection points are positioned around the shaft of the bat. Similarly, the rehabilitation exercise device has two connection points, the proximal and distal connection points, which are designed to attach to a user, such that the rehabilitation exercise device secures to a user. The term "proximal" is used herein to refer to a relative position of a structural component being closer to a user of the underlying apparatus, whereas the term "distal" is used herein to refer to a relative position of a structural component being further from the user of the underlying apparatus. The distal connection point typically is disposed near one end of the device, with other components adjustably disposed distal to the distal connection point. The proximal connection point is disposed either near the opposite end of the device or in the middle of the device. This general configuration will become clearer as this specification continues.

Once both connection points are positioned around the shaft of the bat, the training device continues to slide distally until a stationary component (e.g., inner bearing, O-ring, etc.) in the proximal connection point tightens around the shaft of the bat to secure the device to the bat. This typically occurs when the diameter of the shaft of the bat increases to where the shaft abuts the inner perimeter of the proximal connection point and the proximal connection point fits snugly around the shaft. The distal connection point can have an inner diameter that is larger than the largest outer diameter of the bat, thus allowing the distal connection point to remain loose around the shaft of the bat. In this way, the proximal connection point is the primary mechanism by which the training device is secured to the shaft of the bat. Similarly, the connection points may be securable to a user's limb or other body part while the rehabilitation exercise device is in use, which will be discussed in greater detail later in this specification.

The proximal connection point further includes a rotating component (e.g., outer bearing) disposed in outer relation to the stationary component of the proximal connection point, and this rotating component rotates around the stationary component when the stationary component is secured to the shaft of the bat. As such, this rotating component permits the rotation of the training device 360° around the shaft of the bat in a nearly frictionless manner. It should be noted that the distal connection point, having an inner diameter larger than the largest outer diameter of the bat and/or being semi-loosely positioned around the distal end of the bat, can rotate freely around the distal end of the bat, thus also contributing to the nearly-frictionless 360° rotation of the training device around the bat.

The rotating component (outer bearing) of the proximal connection point is separable and hinged to open in order to allow access to the stationary component (inner bearing) for cleaning, replacement, maintenance, or other need.

The training device can further include a proximal rigid member and a distal rigid member (handle) with a drag chute disposed and affixed therebetween. One end of the drag chute is connected to the proximal rigid member, and the opposite end of the drag chute is connected to the distal rigid member. At least one support rod is also positioned (and optionally affixed) between the proximal rigid member and the distal rigid member and runs along the length of the drag chute, where one end of the support rod is secured at/to the proximal rigid member and the opposite end of the support rod is secured at/to the distal rigid member.

Between the rigid members, the support rod passes through a channel in each of the connection points. As such, the connection points are slidable along the length of the support rod. To maintain the stability of connection points as they slide along the support rod, a stability bar can be disposed between the connection points, where one end of the stability bar is secured at/to the proximal connection point and the opposite end of the stability bar is secured at/to the distal connection point. In this way, the proximal connection point, the distal connection point, and the stability slide in unison along the support rod.

Due to this slidability, the resistance provided by the drag chute during a swing of the bat (or other swinging sports equipment, or a user's body part) is adjustable. Any suitable mechanism can be used to secure or lock the connection points to the support rod. When the connections points are secured or locked to the support rod, they are fixed in place and the training device can be used. When the connection points are unsecured or unlocked from the support rod, they can slide along the support rod.

Moving the connection points distally relative to the drag chute (or alternatively moving the drag chute proximally relative to the connection points) decreases the resistance caused by the drag chute during a swing. When the distal connection point is adjacent to the distal rigid member or the distal end of the drag chute, there is minimal resistance from the training device. On the other hand, moving the connection points proximally relative to the drag chute (or alternatively moving the drag chute distally relative to the connection points) increases the resistance caused by the drag chute during a swing. When the proximal connection point is adjacent to the proximal rigid member or the proximal end of the drag chute, there is maximum resistance from the training device.

EXAMPLES

Figure 11:
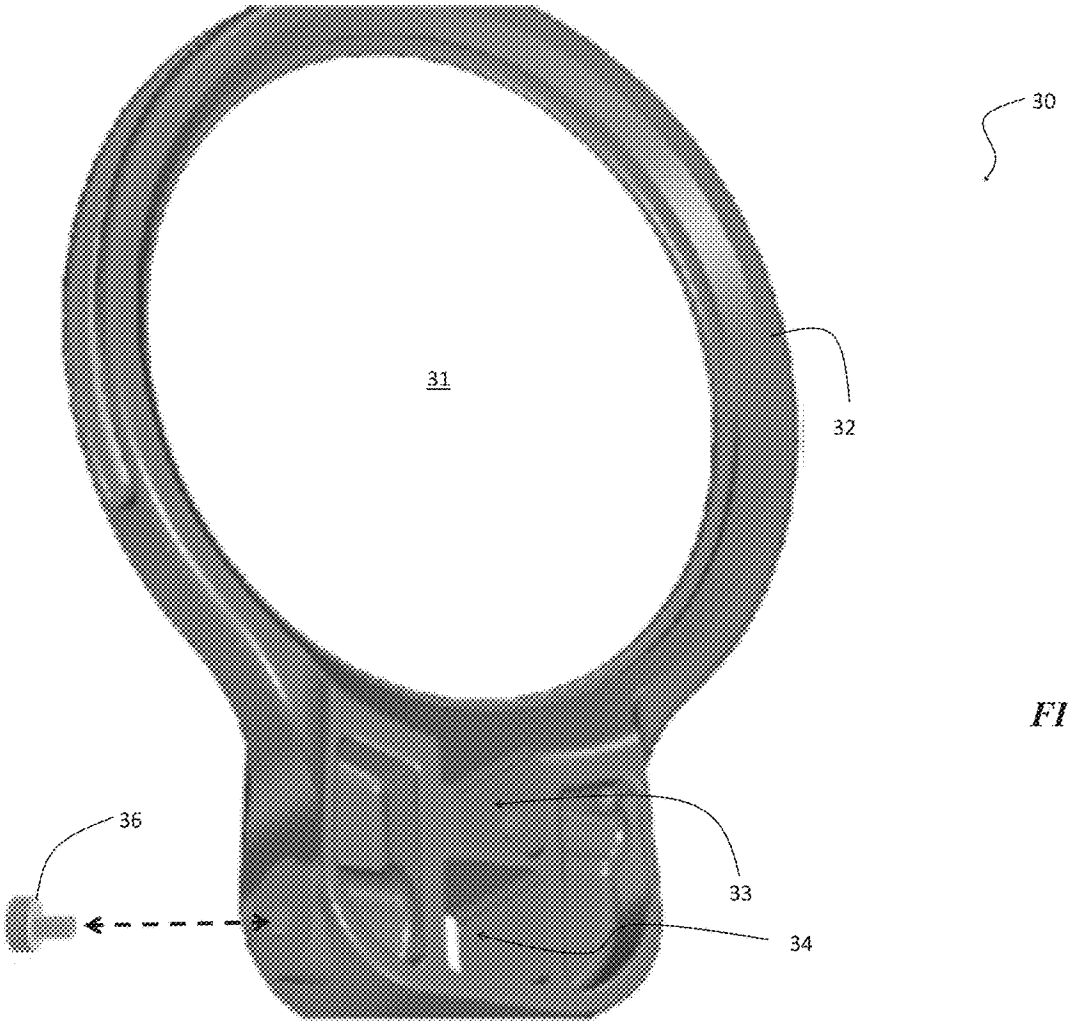
FIG. 11 is a close-up perspective view of a distal coupling element, according to an embodiment of the current invention.
Figure 12A:
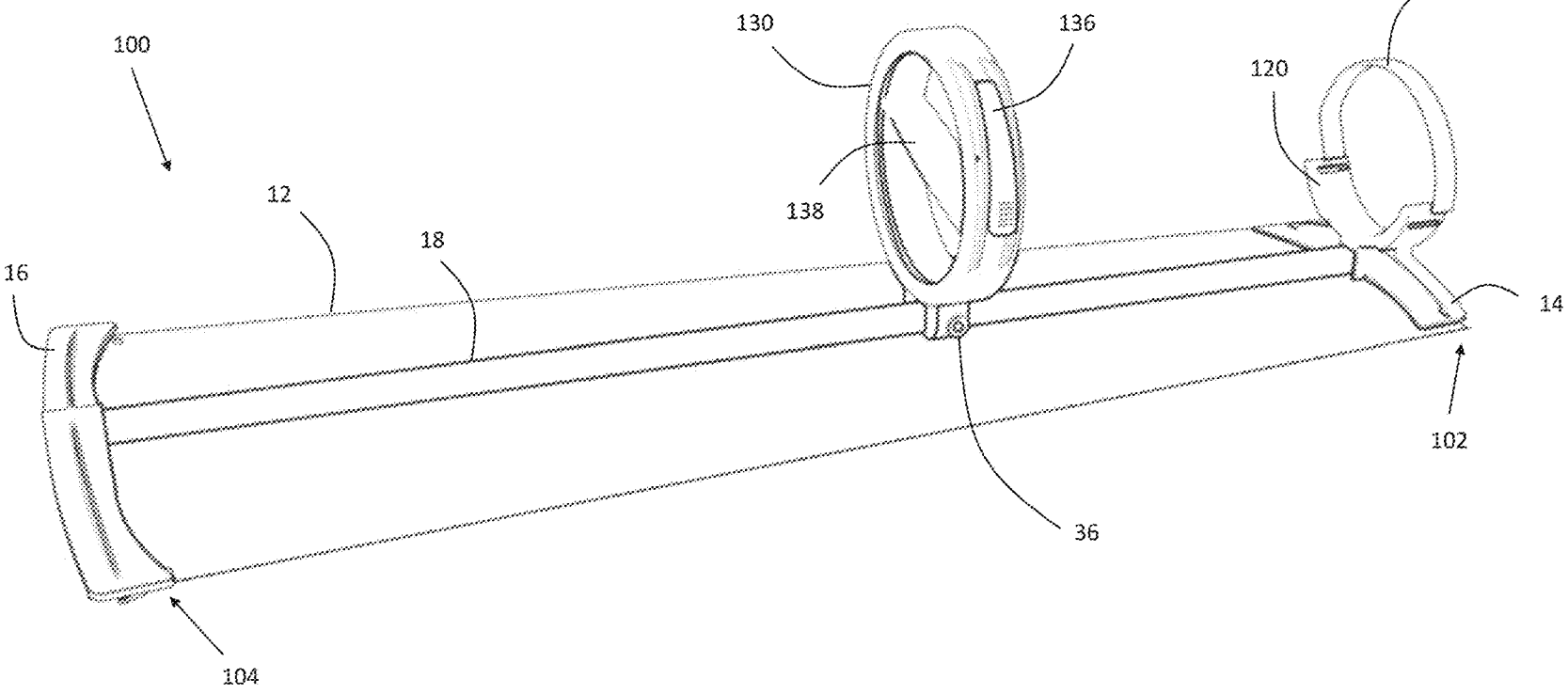
FIG. 12A is a top and side perspective view of a rehabilitation exercise device, according to an embodiment of the current invention.
Figure 12B:
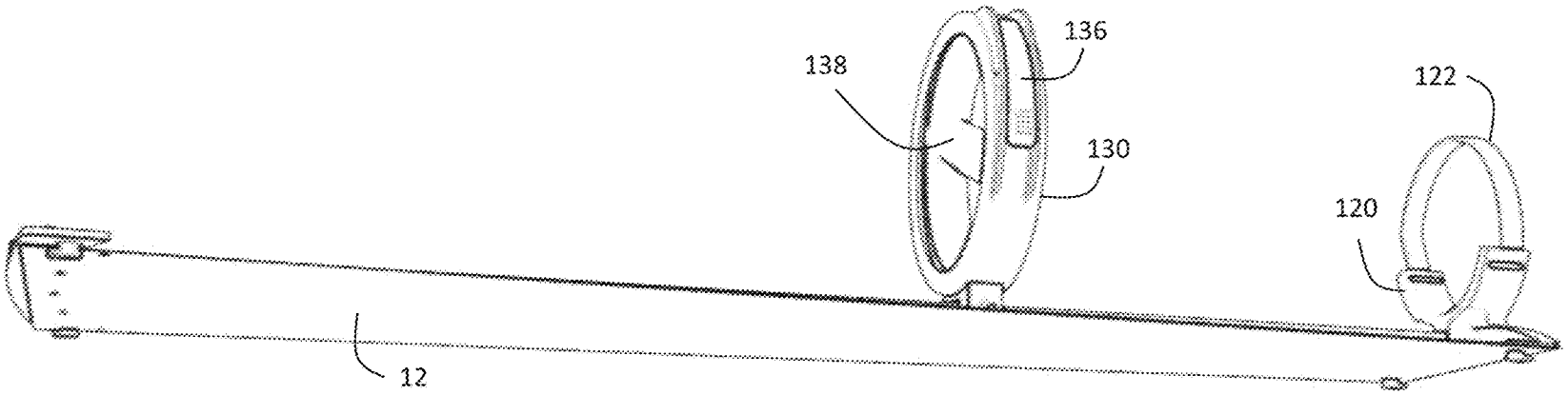
FIG. 12B is a bottom and side perspective view of a rehabilitation exercise device, according to an embodiment of the current invention.
Figure 12C:
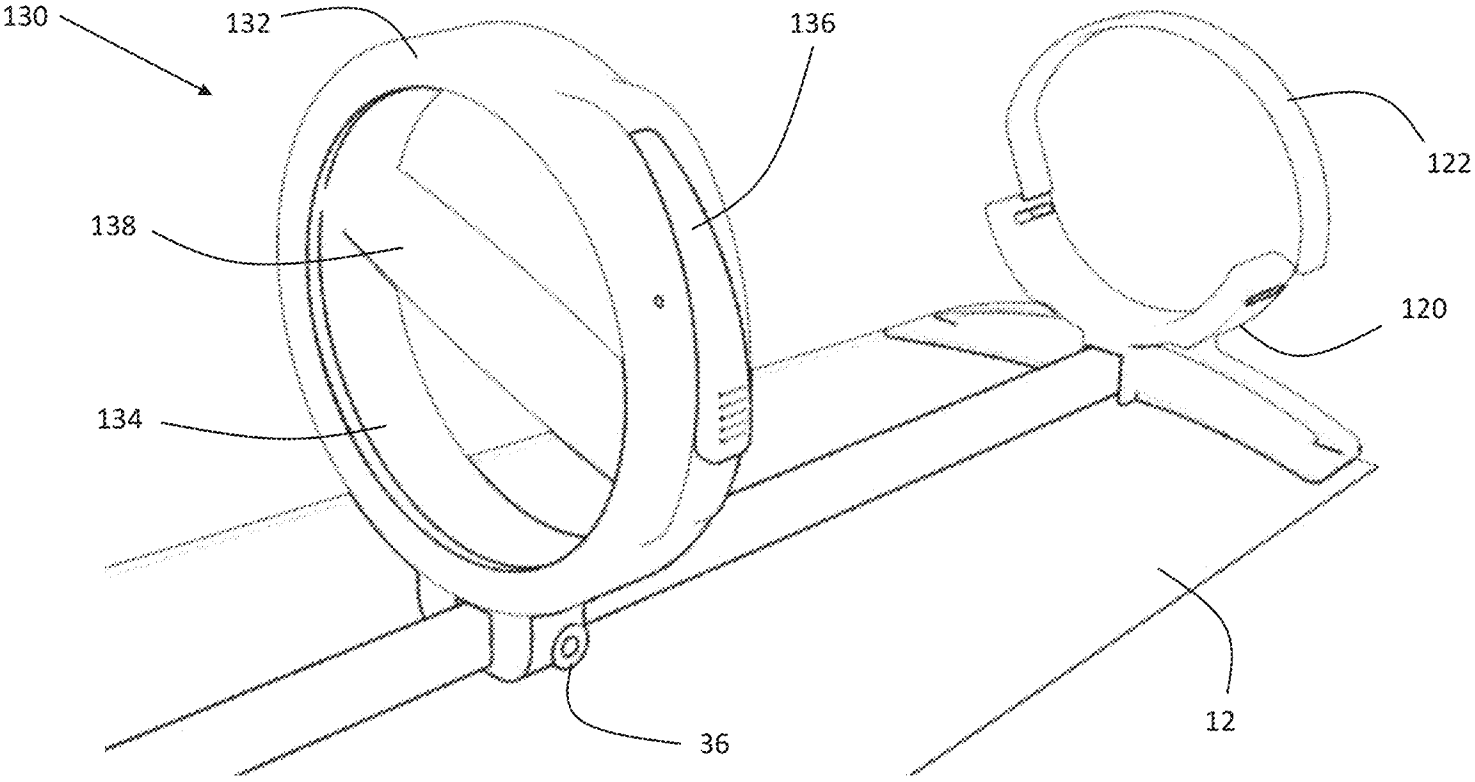
FIG. 12C is a close-up perspective view of a proximal coupling element and a distal coupling element, according to an embodiment of the current invention.
Figure 12D:
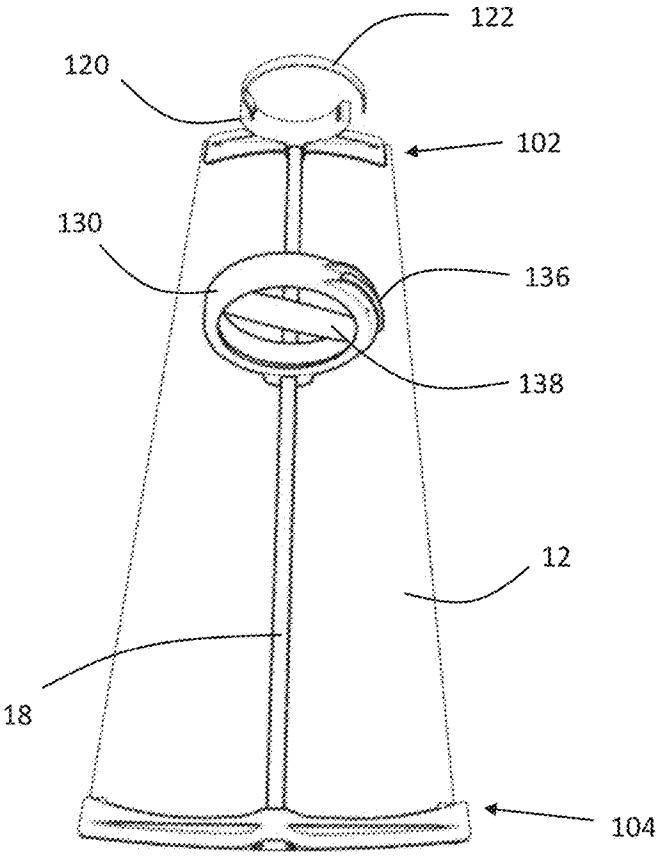
FIG. 12D is a top perspective view of a rehabilitation exercise device, according to an embodiment of the current invention.

In an embodiment, depicted in FIG. 11, the current invention is a swing training apparatus, generally denoted by the reference numeral 10, as applied to swinging sports apparatus B. As shown in FIG. 1, which is an exploded view of device 100 from a front elevated perspective, apparatus 10 generally includes drag chute/panel 12, proximal rigid member 14, distal rigid member 16, support rod 18, proximal coupling element 20, distal coupling element 30, and stability bar 40. Each of these components will become clearer as this specification continues.

Figure 4:
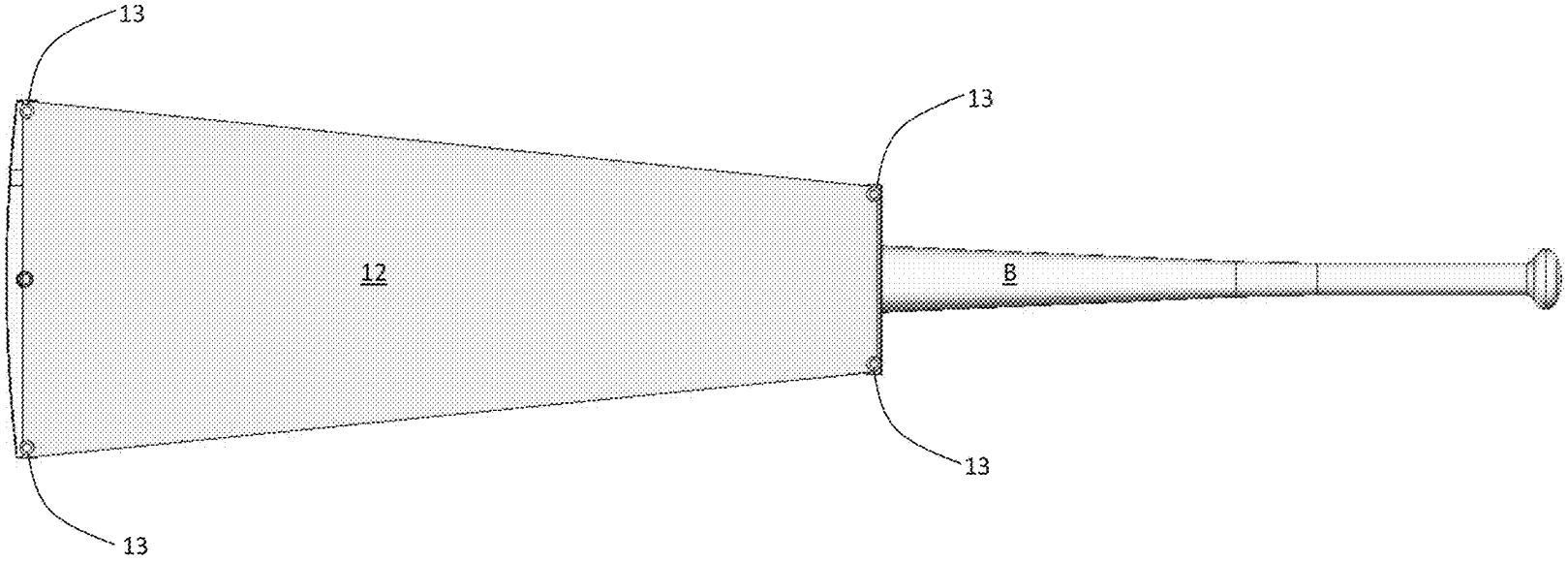
FIG. 4 is a rear elevated view of a sports swinging exercise and training apparatus, according to an embodiment of the current invention.
Figure 5:
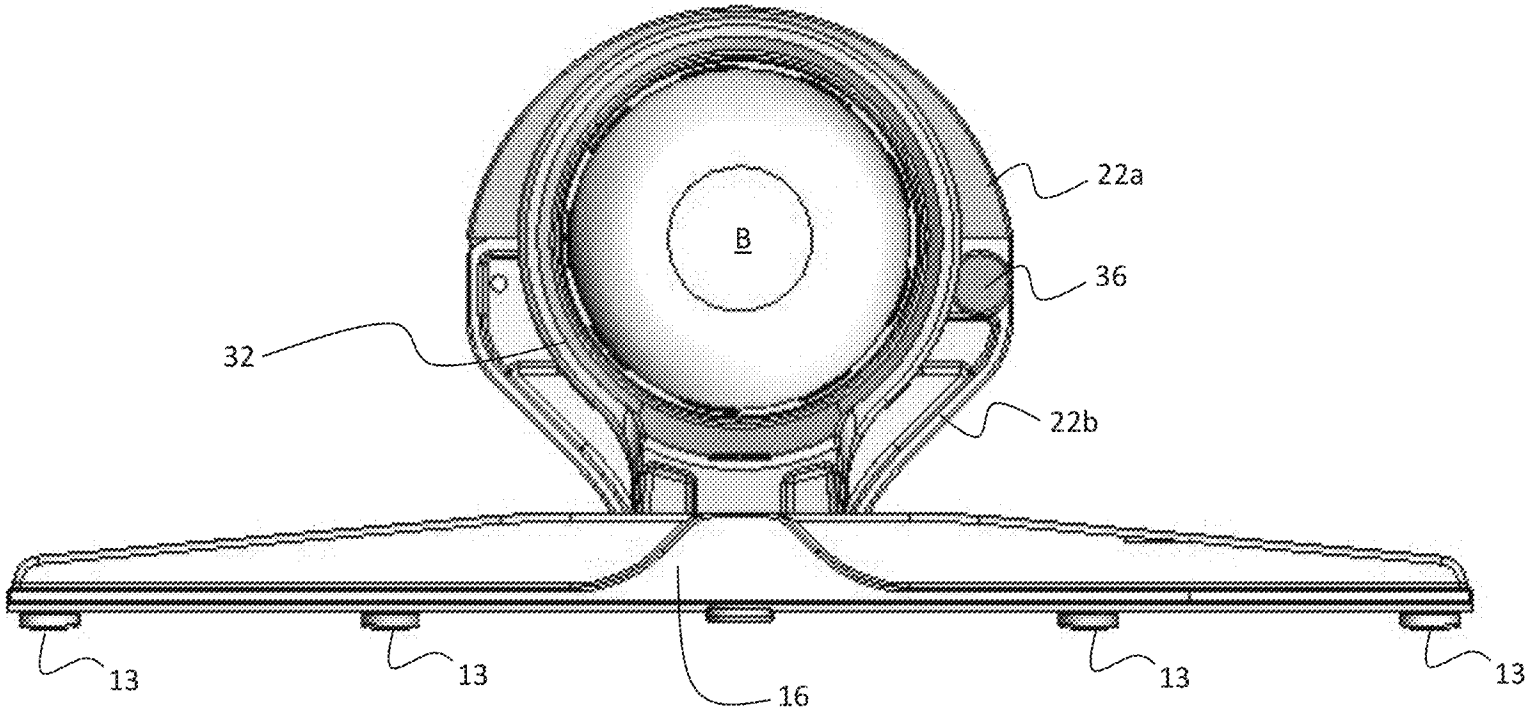
FIG. 5 is a top end view of a sports swinging exercise and training apparatus, according to an embodiment of the current invention.
Figure 6:
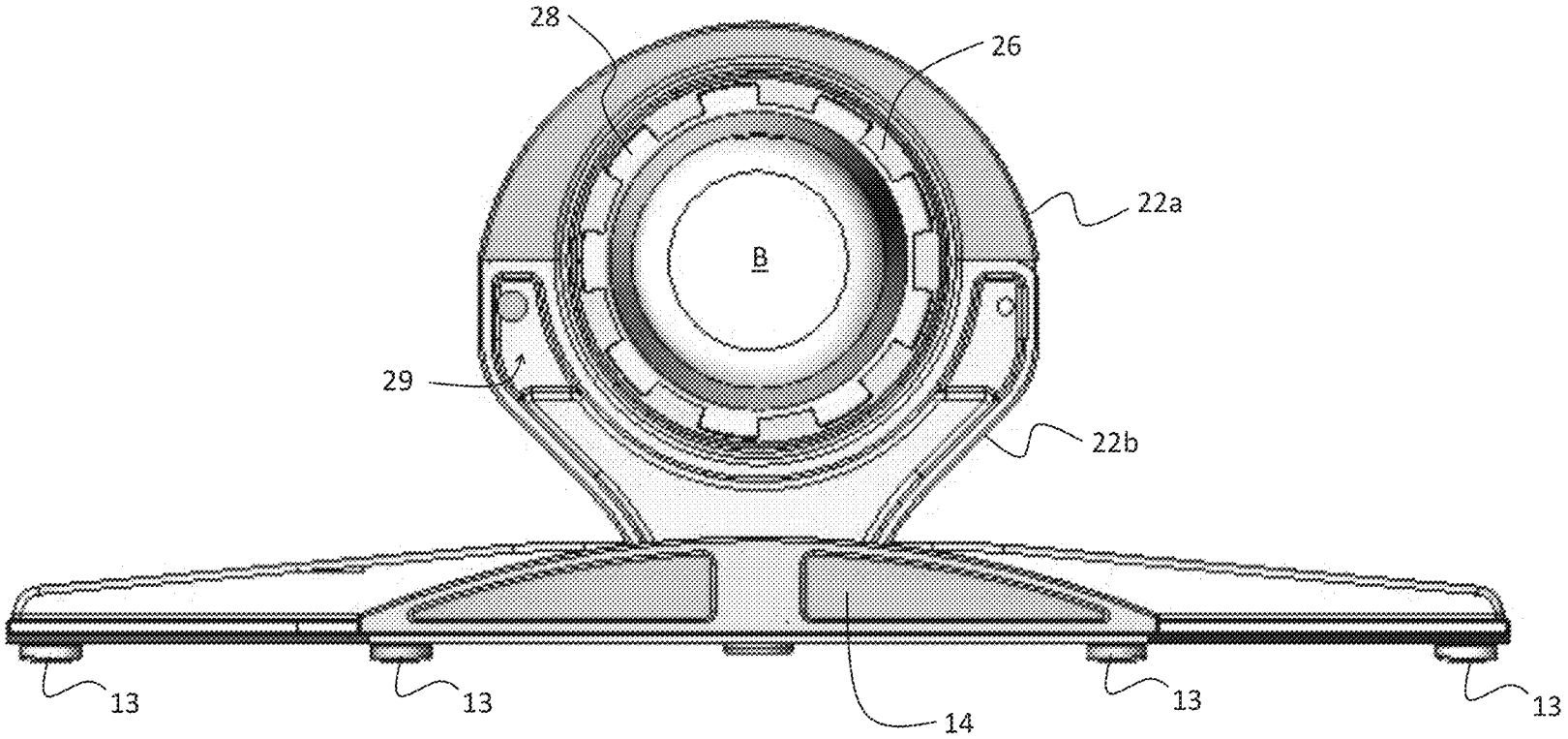
FIG. 6 is a bottom end view of a sports swinging exercise and training apparatus, according to an embodiment of the current invention.
Figure 7:
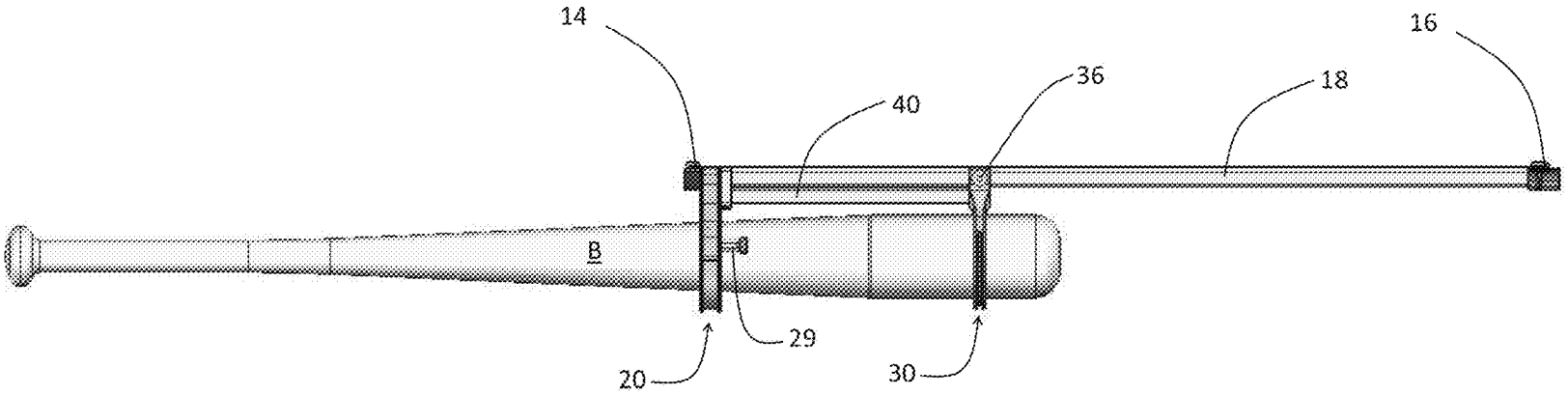
FIG. 7 is a side elevated view of a sports swinging exercise and training apparatus, according to an embodiment of the current invention.
Figure 8:
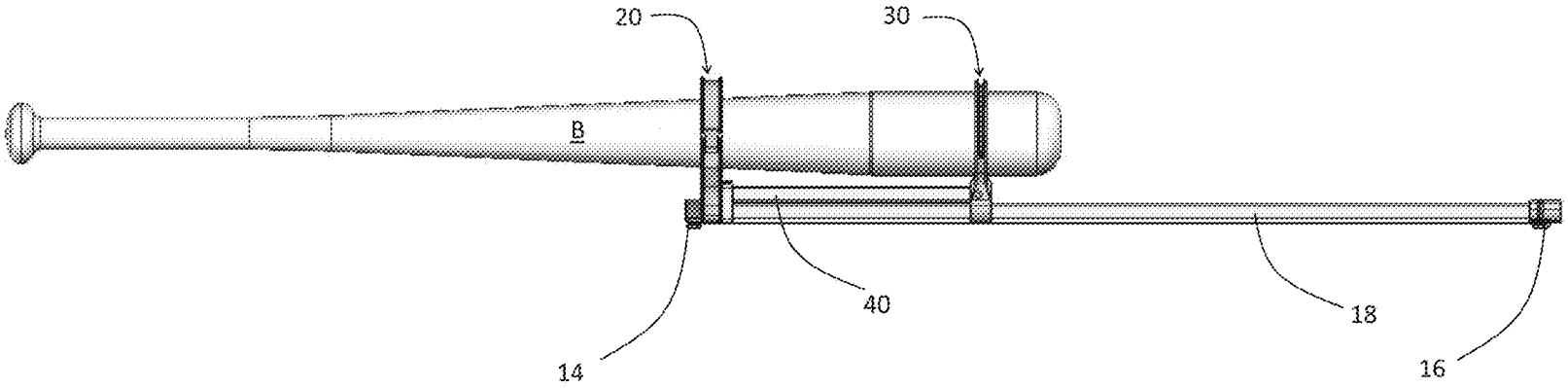
FIG. 8 is a side elevated view of a sports swinging exercise and training apparatus, according to an embodiment of the current invention.
Figure 9:
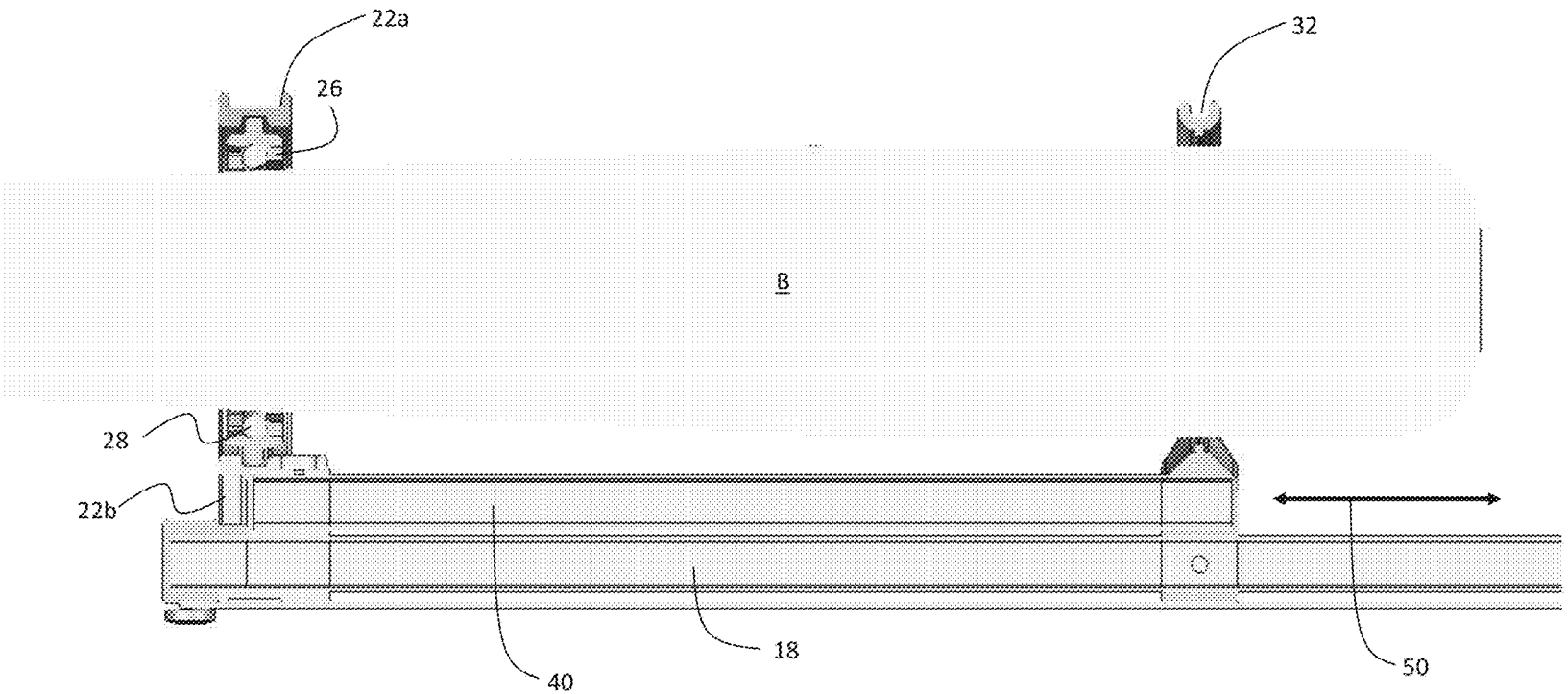
FIG. 9 is a close-up cross-sectional view of the connection points between a sports swinging exercise and training apparatus and a bat, according to an embodiment of the current invention.

Drag chute 12 extends along the length of apparatus 10. The proximal end of chute 12 is coupled or secured in any way to proximal rigid member 14, and the distal end of chute 12 is coupled or secured in any way to distal rigid member 16. Any suitable method of coupling chute 12 to rigid members 14, 16 is contemplated herein. An example is snap buttons 13 at each corner of chute 12 and at each end of rigid members 14, 16 (see FIG. 4). Other fastening mechanisms are contemplated as well. Additionally, chute 12 can be formed of any suitable flexible material, such as a cloth, textile, or polymer. Any suitable material is contemplated herein, dependent on the needs of the user or resistance desired. Chute 12 may take any shape or configuration, as desired or needed by the user. For example, the figures depict a trapezoidal shape for chute 12.

Rigid members 14, 16 are typically inflexible and are disposed along the lateral/short sides of chute 12. Rigid members 14, 16 provide stability to chute 12—maintaining alignment of chute 12 and preventing twisting of chute 12—during a swing of bat B with apparatus 10 installed thereon. Distal rigid member 16 may be utilized as a handle as well and have the appropriate structural features for a handle.

Apparatus 10 further includes at least one support rod 18 extending along the longitudinal axis of chute 12. In certain embodiments, support rod 18 extends along the substantial center of chute 12 between proximal rigid member 14 and distal rigid member 16. Typically, the proximal end of support rod 18 is coupled to or generally secured at proximal rigid member 14, and the distal end of support rod 18 is coupled to or generally secured at distal rigid member 16.

Support rod 18 provides stability/rigidity to chute 12, proximal rigid member 14, and distal rigid member 16 during rotation around bat B. In other words, support rod 18 permits chute 12, proximal rigid member 14, and distal rigid member 16 to rotate in synchronization during rotation around bat B. This will become clearer as this specification continues.

Figure 10:
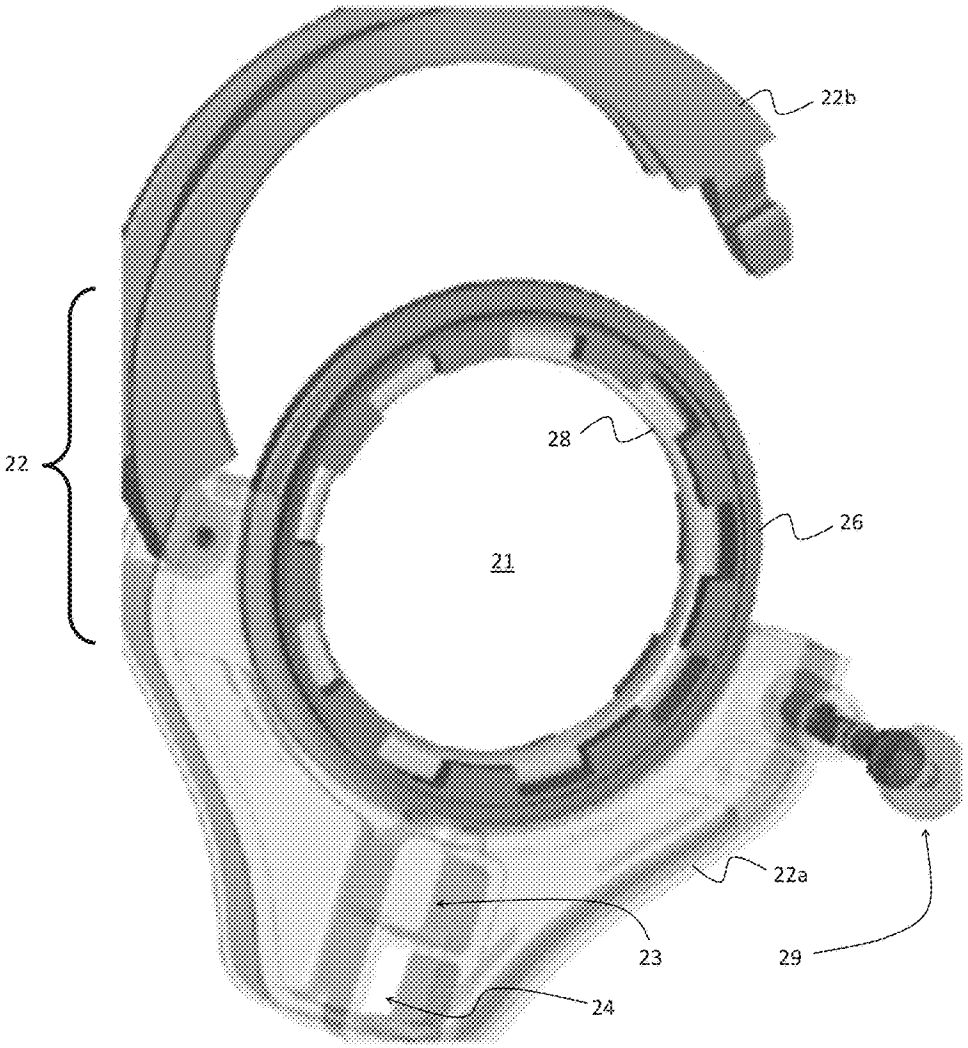
FIG. 10 is a close-up perspective view of a proximal coupling element, according to an embodiment of the current invention.

Apparatus 10 further includes proximal coupling element 20, which includes inner aperture 21 and is formed of outer bearing 22 with stability bar slot 23 and support rod channel 24 therein, inner bearing 26, and O-ring 28. Outer bearing 22 is formed of two (2) halves/components indicated by reference numerals 22*a* and 22*b*. Components 22*a*, 22*b* are disposed in hinged relation to one another, such that component 22*b* remains affixed to component 22*a* at one end and is detachable from component 22*a* at the opposite end (see FIG. 10). This ability for outer bearing 22 to open permits access to inner bearing 26 and O-ring 28 for cleaning, maintenance, replacement, or other need. It is contemplated herein that different sizes of inner bearings and O-rings can be used, depending on the swinging sports apparatus being used. For example, a baseball bat, a softball bat, and a youth bat all have different sizes and may require different fittings for apparatus 10.

Any suitable mechanism can be used for opening and closing outer bearing 22. Examples include, but are not limited to, a biased and retractable knob/pin indicated by reference numeral 29, a clip, a screw, a cotter pin, and a snap joint, among others. As seen in the figures (in particular FIG. 10), retractable knob 29 is pulled to release component 22*b* from component 22*a*. As such, outer bearing 22 can be opened to access inner bearing 26 and O-ring 28 when needed.

Inner bearing 26 and O-ring 28 have an inner diameter that is smaller than a largest diameter of the shaft of bat B. In this way, bat B can slide through inner aperture 21 until the inner edges of inner bearing 26 and/or O-ring 28 contact the shaft of bat B. Inner bearing 26 and/or O-ring 28 are then secured around the shaft of bat B. Inner bearing 26 and/or O-ring 28 remain stationary around the shaft of bat B, while the remaining components of apparatus 10 can rotate 360° around the shaft of bat B. It can be understood that in this scenario, outer bearing 22 has an inner diameter that is larger than the inner diameter of inner bearing 26 and O-ring 28. Due to this difference in diameters, not only can inner bearing 26 and O-ring 28 remain within outer bearing 22 without slipping out, but outer bearing 22 can also rotate around inner bearing 26. It can also be understood that both of inner bearing 26 and O-ring 28 may not be required, as inner bearing 26 (acting as the stationary component) alone may be sufficient to hold bat B in place while outer bearing 22 (acting as the rotating component) rotates therearound. Within the stationary component or within inner bearing 26, O-ring 28 is simply an additional layer of friction with bat B to maintain its position. When apparatus 10 is installed onto bat B, inner bearing 26 and/or O-ring 28 provide the necessary friction to maintain secure position around the shaft of bat B, i.e., friction sufficient to prohibit movement of inner bearing 26 and/or O-ring 28 around bat B.

Apparatus 10 further includes distal coupling element 30. In certain embodiments, it is contemplated that distal coupling element 30 can take a similar configuration as proximal coupling element 20 with its corresponding inner bearing secured to bat B and its corresponding outer bearing rotating about the inner bearing. However, if bat B has varying diameters along its length, as many baseball/softball bats do, a simpler mechanism is presented herein. Distal coupling element 30 includes inner aperture 31 and is formed of annular ring 32, stability bar slot 33, and support rod channel 34. Typically, inner aperture 31 of distal coupling element 30 has a diameter that is larger than the largest diameter of bat B. This allows distal coupling element 30 to be loosely/laxly disposed around the shaft of bat B, thus permitting substantially free rotation of distal coupling element 30 around the shaft of bat B. It should be noted that inner bearing 26 and/or O-ring 28 keep apparatus 10 secure on bat 13, so distal coupling element 30 and chute 12 cannot move longitudinally along bat B (i.e., they can only rotate around bat B).

As noted previously, proximal coupling element 20 includes support rod channel 24, and distal coupling element 30 includes support rod channel 34. Further, proximal rigid member 14 includes support rod slot 14', and distal rigid member 16 includes support rod slot 16'. Support rod 18 extends along chute 12 from support rod slot 14' of proximal rigid member 14, through support rod channel 24 of proximal coupling element 20, through support rod channel 34 of distal coupling element 30, and into support rod slot 16' of distal rigid member 16. In this way, support rod 18 is secured in place along chute 12 at proximal rigid member 14 and distal rigid member 16, while proximal coupling element 20 and distal coupling element 30 can slide along support rod 18 in the directions indicated by arrows 50. As coupling elements 20, 30 are positioned further distally along support rod 18, the resistance provided by apparatus 10 during a swing of bat B decreases. As coupling elements 20, 30 are positioned further proximally along support rod 18, the resistance provided by apparatus 10 during a swing of bat B increases. It should be noted that bat B moves in synchronization with movement of coupling elements 20, 30, due to inner bearing 26 and/or O-ring 28 of proximal coupling element 20 being affixed to bat B. Thus, as coupling elements 20, 30 slide further proximally along support rod 18, there is less overlap between bat B and chute 12, resulting in a greater surface area of chute 12 being exposed during a swing and thus causing greater drag resistance.

Apparatus 10 can further include stability bar 40 disposed between proximal coupling element 20 and distal coupling element 30. Stability bar maintains a constant spaced distance between proximal coupling element 20 and distal coupling element 30 at any point along support rod 18. Therefore, as proximal coupling element 20 and distal coupling element 30 slide along support rod 18, they slide in unison with stability bar 40. Other methods of directly or indirectly coupling proximal coupling element 20 and distal coupling element 30 together are contemplated herein. The end result should simply be that coupling elements 20, 30 can slide along support rod 18 as one overall unit (i.e., in unison). If stability bar 40 is used to accomplish this goal, it can be secured on one end within stability bar slot 23 of proximal coupling element 20 and on an opposite end within stability bar slot 33 of distal coupling element 30.

To prevent sliding during a swing of bat B, a locking mechanism is typically present on proximal coupling element 20, distal coupling element 30, or stability bar 40. The locking mechanism is also in communication with support rod 18. This locking mechanism affixes proximal coupling element 20, distal coupling element 30, and stability bar 40 to support rod 18, so that when bat B is swung with apparatus 10 installed thereon, there is no sliding along support rod 18, i.e., there is only rotation around bat B. When the locking mechanism is unlocked, coupling elements 20, 30 and stability bar 40 can freely slide along support rod 18; when the locking mechanism is locked, coupling elements 20, 30 and stability bar 40 cannot freely slide along support rod 18. This locking mechanism can take any form, for example adjustment bolt 36, a biased and retractable knob/pin, a clip, a screw, a cotter pin, and a snap joint, among others.

It is contemplated herein that all components of apparatus 10 can be affixed to one another (e.g., via welding), can be separable for one another (i.e., break down into individual components as seen in FIG. 1, or can have certain components be affixed and others be separable, Additionally, it is contemplated that apparatus 10 can be affixed or separable from bat B. For example, support rod 18 and/or bat B may be attached to bearings 22, 26 permanently or may be separable from bearings 22, 26.

In the situation where apparatus 10 is detachable from bat B, the operation of apparatus 10 by a user proceeds as follows. Bat B is provided. To assemble apparatus 10, the proximal end of support rod 18 is coupled to proximal rigid member 14 (e.g., through support rod slot 14'). The distal end of support rod 18 is then inserted through support rod channel 24 of proximal coupling element 20, and proximal coupling element 20 slides proximally along support rod 18. Stability bar 40 is coupled to proximal coupling element 20 (e.g., through stability bar slot 23). The distal end of support rod 18 is then inserted through support rod channel 34 of distal coupling element 30, and distal coupling element 30 slides proximally along support rod 18 until stability bar 40 is coupled to distal coupling element 30 (e.g., through stability bar slot 33). Subsequently, the distal end of support rod 18 is coupled to distal rigid member 16 (e.g., through support rod slot 16'). The proximal end of chute 12 is then coupled to proximal rigid member 14, and the distal end of chute 12 is coupled to distal rigid member 16.

With apparatus 10 assembled, the knob end of bat B is inserted through aperture 31 of distal coupling element 30 and further through aperture 21 of proximal coupling element 20. Bat B continues passing through apertures 31, 21 until an inner edge of proximal coupling element 20 contacts the shaft of bat B and is secured in place, so that bat B can no longer pass through apertures 31, 21. Adjustment bolt 36 (or other locking mechanism) can be tightened until adjustment bolt 36 exerts a sufficient pressure on support rod 18 so that coupling elements 20, 30 and stability bar 40 are secured to support rod 18. The user can begin using apparatus 10 at this point simply by swinging bat B and experiencing the resistance provided by the drag of chute 12. Regardless of which direction the user swings bat 13, the user will experience the drag resistance of chute 12, due to apparatus 10 (with exception to the stationary component(s) of proximal coupling element 20) rotating 360° around the shaft of bat B.

If the user wishes to increase the resistance provided by chute 12, the user can unscrew/unlock adjustment bolt 36, slide coupling elements 20, 30 and stability bar 40 proximally, and re-lock adjustment bolt 36. This exposes a greater surface area of chute 12 to drag during a swing of bat B. On the other hand, if the user wishes to decrease the resistance provided by chute 12, the user can unscrew/unlock adjustment bolt 36, slide coupling elements 20, 30 and stability bar 40 distally, and re-lock adjustment bolt 36. This exposes a smaller surface area of chute 12 to drag during a swing of bat B.

If the user wishes to use apparatus with a smaller bat, the user can unlock/open proximal coupling element 20, remove inner bearing 26 (including O-ring 28 if present), replace it with an alternative inner bearing that has a smaller inner diameter, and lock/close proximal coupling element 20. A smaller inner diameter of the alternative inner bearing permits a smaller-diameter bat to be used with apparatus 10.

Ultimately, with apparatus 10 installed on bat B with the appropriate inner bearing installed and with the appropriate resistance level set, the following components of apparatus 10 can rotate in synchronization around the shaft of bat B during a swing: drag chute 12, proximal rigid member 14, distal rigid member 16, support rod 18, outer bearing 22 of proximal coupling element 20, distal coupling element 30, and stability bar 40. During rotation of these components, inner bearing 26 and O-ring 28 remain stationary on the shaft of bat B.

Figure 13:
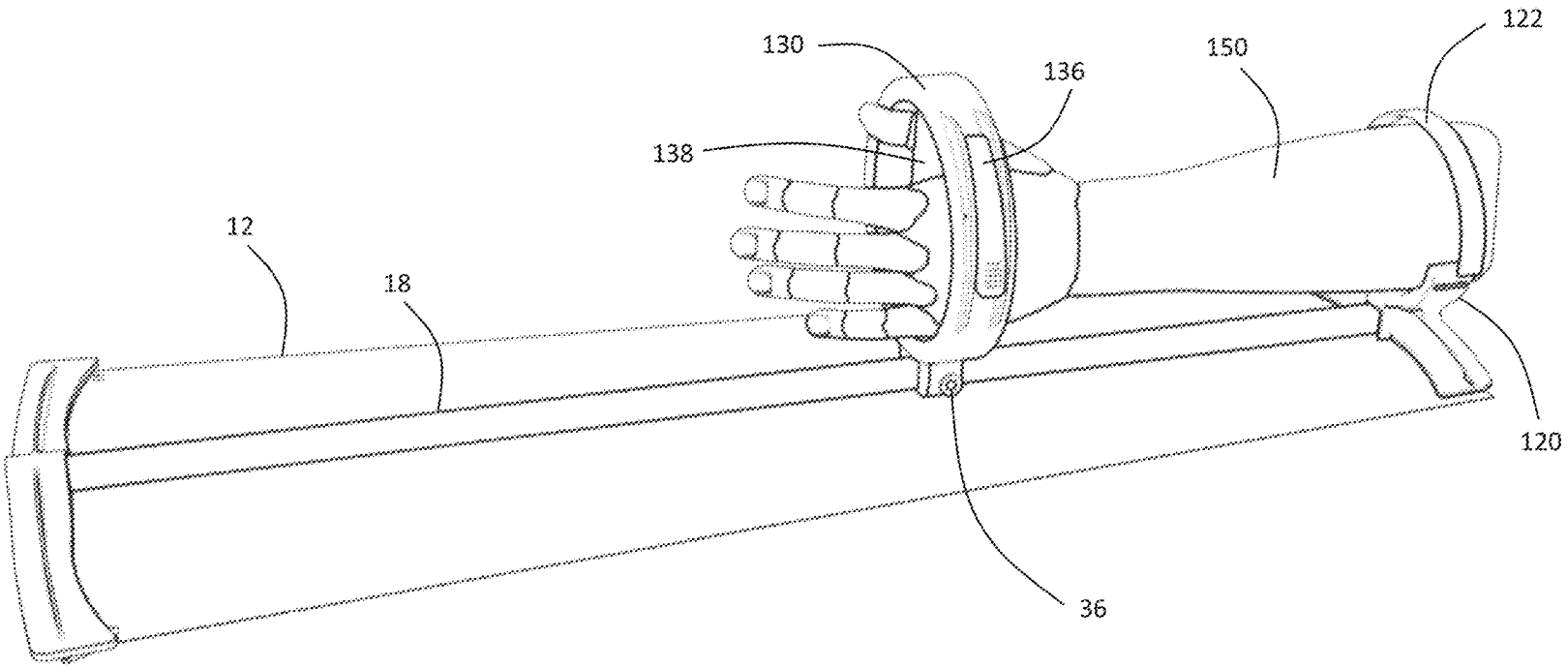
FIG. 13 is a side perspective view of a rehabilitation exercise device in use in combination with a user's limb, according to an embodiment of the current invention.

In an alternative embodiment, depicted in FIGS. 12-13, the current invention is a rehabilitation exercise device, generally denoted by the reference numeral 100 (and which may be referred to herein as rehabilitation apparatus). Rehabilitation apparatus 100 shares many of the same components with sports training apparatus 10. For example, rehabilitation apparatus 100 includes chute 12 extending along a length thereof from proximal end 102 to distal end 104. Chute 12 secures to proximal rigid member 14 disposed adjacent to proximal end 102, and distal rigid member 16 disposed adjacent to distal end 104. In addition, rehabilitation apparatus 10 includes at least one support rod 18 extending along the longitudinal axis of chute 12, from proximal end 102 to distal end 104. Much the same as for sports training apparatus 10 described above, support rod 18 of rehabilitation apparatus 100 extends along the substantial center of chute 12 between proximal rigid member 14 and distal rigid member 16, with support rod 18 being coupled to or generally secured at each of proximal rigid member 14 and distal rigid member 16.

Rehabilitation apparatus 100 further includes proximal coupling element 120 disposed adjacent to proximal rigid member 14. Similar to proximal coupling element 20 described in detail above, proximal coupling element 120 is slidably secured to support rod 18. Moreover, rehabilitation apparatus 100 includes distal coupling element 130 disposed between proximal coupling element 120 and distal end 104 of apparatus 100. Distal coupling element 130 is similar to distal coupling element 30 described in detail above, such that distal coupling element 130 is slidably secured to support rod 18. Proximal coupling element 120 and distal coupling element 130 can translate independent from each other along support rod 18, or can translate together thereby maintaining a predetermined distance between the elements. Moreover, similar to training apparatus 10 above, distal coupling element 130 includes adjustment bolt 36 that, when tightened, exerts a sufficient pressure on support rod 18 so that distal coupling element 130 secures against support rod 18, thereby immobilizing distal coupling element 130 with respect to support rod 18.

As discussed in the training apparatus 10 embodiment above, one or more of distal coupling element 130 and proximal coupling element 120 can slide along support rod 18 to change a resistance of chute 12 when rehabilitation apparatus 100 is swung by a user. For example, chute 12 provides more resistance when a greater surface area of chute 12 is exposed; as such, to increase the resistance provided by chute 12, a user slides at least distal coupling element 130 toward proximal end 102 of rehabilitation apparatus 100. Similarly, chute 12 provides less resistance when a lesser surface area of chute 12 is exposed; as such, to decrease the resistance provided by chute 12, a user slides at least distal coupling element 130 toward distal end 104 of rehabilitation apparatus 100. To translate distal coupling element 130 along support rod 18, a user loosens adjustment bolt 36, thereby reducing the pressure exerted by adjustment bolt 36 on support rod 18, allowing distal coupling element 130 to slide along support rod 18.

As shown particularly in FIG. 13, proximal coupling element 120 and distal coupling element 130 are designed such that a user can insert one of his or her limbs through proximal coupling element 120 toward distal coupling element 130. As such, proximal coupling element 120 includes adjustable strap 122 secured thereto, such that after a user inserts, for example, an arm through proximal coupling element 120, strap 122 can be tightened and loosened to either secure the arm to rehabilitation apparatus 100, or provide for disengagement from rehabilitation apparatus 100. Strap 122 can be inserted within a channel disposed in proximal coupling element 120 to adjust the length of strap 122 disposed outside the coupling element. Alternatively, the entirety of strap 122 may be disposed external to proximal coupling element 120, similar to an orientation of a traditional wristwatch. Regardless of the disposition of strap 122, any suitable mechanism can be used for adjusting strap in relation to proximal coupling element. Examples include, but are not limited to, a biased and retractable knob/pin, a clip, a screw, a cotter pin, a snap joint, a hook-and-loop mechanism, and a button coupling, among others.

While the location of distal coupling element 130 is most similar to that of distal coupling element 30 discussed above, the components of distal coupling element 130 are most similar to those of proximal coupling element 20, described in detail above. For example, proximal coupling element 20 includes outer bearing 22 and inner beating 26, with the bearings being rotatable independent from each other. Similarly, distal coupling element 130 includes outer housing 132 and inner bearing 134, with inner bearing 134 being rotatable with respect to outer housing 132. However, inner bearing 134 differs from inner bearing 26 in at least one important way—inner bearing 134 further includes handle 138, which is rotatable when inner bearing 134 rotates with respect to outer hosing 132. Handle 138 provides a gripping component that a user can grip, such that the user can securely hold rehabilitation apparatus 100 during use, as shown in FIG. 13.

The rotation of inner bearing 134 with respect to outer housing 132 is an important aspect of rehabilitation apparatus 100, since the rotation allows a user to selectively position his or her limb within rehabilitation apparatus 100 depending on the desired exercise goal. For example, an exercise may call for simultaneous swinging of the user's arm and rotation of the user's wrist—as such, the user can easily perform the exercise by gripping handle 138, swinging his or her arm coupled to rehabilitation apparatus 100, and rotating his or her wrist, thereby rotating inner bearing 134 with respect to outer housing 132. On the other hand, other exercises may not call for a rotation of inner bearing 134 with respect to outer housing 132. For example, an exercise may require a user to maintain his or her wrist in a particular position so that the user can safely increase arm muscle strength without the need for wrist rotation.

Accordingly, distal coupling element 130 further includes obstruction member 136, which is disposed along outer housing 132 and it in mechanical communication with inner bearing 134. Obstruction member 136 includes at least two orientations open, in which obstruction member 136 is not in contact, either direct or indirect, with inner bearing 134, such that inner bearing 134 is capable of relatively freely rotating with respect to outer housing 132; and closed, in which obstruction member 136 is in contact, either direct or indirect, with inner bearing 134, thereby preventing the rotations of inner bearing 134. The mechanical communication between obstruction member 136 and inner bearing 134 may be direct, in which obstruction member 136 directly contacts inner bearing 134 in the closed orientation. Alternatively, the mechanical contact between obstruction member 136 and inner bearing 134 may be indirect, such as via outer housing 132 as an intermediary component. Moreover, obstruction member 136 may prevent the rotation of inner bearing 134 by, for example, pressing against inner bearing 134, either directly or indirectly, such that a frictional force exists between the components, thereby preventing inner bearing 134 from rotating when obstruction member 136 is engaged against inner bearing 134. Alternatively, obstruction member 136 may include a plurality of slots disposed therein, such that an extension of inner bearing 134 may reside within one of the plurality of slots between rotations of inner bearing 134, such that obstruction member 136 prevents the rotation of inner bearing 134 when the extension resides within one of the slots.

An exemplary method of using rehabilitation apparatus 100 is shown in FIG. 13, in combination with FIGS. 12A-12D, as discussed in greater detail above. Rehabilitation apparatus 100 is designed such that a user inserts his or her limb 150 through proximal coupling element 120 toward distal coupling element 130. When limb 150 is inserted through proximal coupling element 120, strap 122 may be tightened against limb 150 to secure proximal coupling element 120 to limb 150. As such, proximal coupling element 120 prevents limb 150 from slipping out of and disengaging from rehabilitation apparatus 100. Rehabilitation apparatus 100 is also designed such that, after limb 150 is inserted through proximal coupling element 120, a portion of limb 150 can reach out and grasp distal coupling element 130, and in particular handle 138. With both proximal coupling element 120 and distal coupling element 130 secured to limb 150, the user can utilize rehabilitation apparatus 100 to perform rehabilitation exercises, particularly those involving one or more of a swinging motion and a rotating motion.

GLOSSARY OF CLAIM TERMS

Annular: This term is used herein to refer to a structure that is shaped like or forms a ring.

Chute: This term is used herein to refer to a typically flexible panel or airfoil that provides air resistance when swinging it in a direction normal to its plane.

Coupling Element: This term is used herein to refer to a structural component by which a user can interact with the rehabilitation device and freely swing and rotate the rehabilitation device.

Distal: This term is used herein to refer to a position further from a user operating the underlying rehabilitation device.

Locked position: This term is used herein to refer to a position of the locking mechanism where the coupling elements are longitudinally affixed to the support rod, such that the coupling elements cannot slide along the support rod.

Locking mechanism: This term is used herein to refer to a structural component by which the coupling elements remains longitudinally affixed to the support rod.

Proximal: This term is used herein to refer to a position closer to a user operating the underlying rehabilitation device.

Rigid member: This term is used herein to refer to a structural component that provides a rigidity to an edge of the panel. This rigidity facilitates synchronized rotation of the rehabilitation device about the user's body part interacting with the rehabilitation device.

Rod: This term is used herein to refer to any shaft or bar having a predefined shape. In certain embodiments, the rod can be secured on one end to the proximal attachment mechanism and secured on its opposite end to the rigid member (e.g., handle). It is contemplated herein that this configuration includes not only a single rod disposed between the proximal attachment mechanism and the rigid member but also a rod that is disposed between the proximal and distal attachment mechanisms and another rod disposed between the distal attachment mechanism and the rigid member. In this latter configuration, it is still contemplated that a rod is disposed between the proximal attachment mechanism and the rigid member; despite the structure being slightly different, it is considered to be equivalent, and the overall function is same.

Stability bar: This term is used herein to refer to a rod or post that maintains a spaced distance between the coupling elements during operation (e.g., operation of resistance, swing of a bat, etc.) of the rehabilitation device.

Substantially freely rotate: This term is used herein to refer to the ability of a structure component to turn or revolve around a point without obstruction or with minimal obstruction. The term "substantially" is used to indicate that the distal attachment mechanism can rotate about the user's body part interacting with the rehabilitation device, thus causing minimal friction to be created between the distal attachment mechanism and the user's body part.

Synchronization: This term is used herein to refer to two events occurring at the same time and with the same speed.

Unlocked position: This term is used herein to refer to a position of the locking mechanism where the coupling elements are not longitudinally affixed to the support rod, such that the coupling elements can slide along the support rod.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A rehabilitation apparatus comprising:

a proximal end opposite a distal end, with a proximal rigid member disposed at the proximal end, and a distal rigid member disposed at the distal end;

a drag chute spanning from the proximal end to the distal end, the drag chute being coupled to each of the proximal rigid member and the distal rigid member;

a support rod secured to each of the proximal rigid member and the distal rigid member, the support rod spanning along a longitudinal axis of the drag chute from the proximal end to the distal end of the rehabilitation apparatus;

a proximal coupling element coupled to the support rod and disposed adjacent to the proximal rigid member, the proximal coupling element defining an aperture through which a user's limb can be inserted;

a distal coupling element coupled to the support rod and disposed between the proximal coupling element and the distal end of the rehabilitation apparatus, the distal coupling element including an outer housing defining an aperture, and a handle coupled to and disposed interior of the outer housing, the handle at least partially extending from the outer housing toward the aperture, such that the user's limb can grasp the handle to swing the rehabilitation apparatus, and such that the drag chute provides resistance when the rehabilitation apparatus travels through air during a rehabilitation exercise; and an adjustment bolt in communication with the distal coupling element and the support rod, the adjustment bolt having a locked orientation and an unlocked orientation, in which in the locked orientation, the adjustment bolt exerts pressure on the distal coupling element to secure the distal coupling element to the support rod, and in which in the unlocked orientation, the adjustment bolt reduces pressure exerted on the distal coupling element, such that the distal coupling element can slidably translate with respect to the support rod.

2. The rehabilitation apparatus of claim 1, further comprising snap buttons at a distal end of the drag chute and a proximal end of the drag chute, such that the snap buttons couple the drag chute to the proximal and distal rigid members.

3. The rehabilitation apparatus of claim 1, further comprising a strap disposed on the proximal coupling element, the strap capable of being tightened against an object, such as the user's limb, to secure the object to the rehabilitation apparatus.

4. The rehabilitation apparatus of claim 1, wherein the distal coupling element further comprises an inner bearing rotatably coupled to the outer housing, with the handle being coupled to the inner bearing and extending from the outer housing toward the aperture.

5. The rehabilitation apparatus of claim 4, wherein the handle is rotatable with respect to the outer housing, such that the user's limb can grip the handle and rotate the handle to perform the rehabilitation exercise.

6. The rehabilitation apparatus of claim 4, further comprising an obstruction member disposed on the outer housing and adapted to be in mechanical communication with the inner bearing to control rotation thereof.

7. The rehabilitation apparatus of claim 6, wherein the obstruction member includes a locked orientation, in which the obstruction member is in mechanical communication with the inner bearing, thereby exerting a force on the inner bearing to prevent rotation thereof.

8. The rehabilitation apparatus of claim 6, wherein the obstruction member includes an unlocked orientation, in which the obstruction member is not in mechanical communication with the inner bearing, such that an obstruction force is not exerted on the inner bearing, and such that the inner bearing can feely rotate with respect to the outer housing.

9. A rehabilitation apparatus comprising:

a proximal end opposite a distal end, with a proximal rigid member disposed at the proximal end, and a distal rigid member disposed at the distal end;

a drag chute spanning from the proximal end to the distal end, the drag chute being coupled to each of the proximal rigid member and the distal rigid member;

a support rod secured to each of the proximal rigid member and the distal rigid member, the support rod spanning along a longitudinal axis of the drag chute from the proximal end to the distal end of the rehabilitation apparatus;

a proximal coupling element coupled to the support rod and disposed adjacent to the proximal rigid member, the proximal coupling element defining an aperture through which a user's limb can be inserted;

a distal coupling element slidably secured to the support rod and disposed between the proximal coupling element and the distal end of the rehabilitation apparatus, the distal coupling element including an outer housing defining an aperture;

a locking mechanism in communication with the distal coupling element and the support rod, the locking mechanism having a locked orientation and an unlocked orientation, in which in the locked orientation, the locking mechanism exerts pressure on the distal coupling element to secure the distal coupling element to the support rod, and in which in the unlocked orientation, the locking mechanism reduces pressure exerted on the distal coupling element, such that the distal coupling element can slidably translate with respect to the support rod; and a handle coupled to and disposed interior of the outer housing, the handle at least partially extending from the outer housing toward the aperture, such that the user's limb can grasp the handle to swing the rehabilitation apparatus, and such that the drag chute provides resistance when the rehabilitation apparatus travels through air during a rehabilitation exercise.

10. The rehabilitation apparatus of claim 9, further comprising snap buttons at a distal end of the drag chute and a proximal end of the drag chute, such that the snap buttons couple the drag chute to the proximal and distal rigid members.

11. The rehabilitation apparatus of claim 9, further comprising a strap disposed on the proximal coupling element, the strap capable of being tightened against an object, such as the user's limb, to secure the object to the rehabilitation apparatus.

12. The rehabilitation apparatus of claim 9, wherein the distal coupling element further comprises an inner bearing rotatably coupled to the outer housing, with the handle being coupled to the inner bearing and extending from the outer housing toward the aperture.

13. The rehabilitation apparatus of claim 12, wherein the handle is rotatable with respect to the outer housing, such that the user's limb can grip the handle and rotate the handle to perform the rehabilitation exercise.

14. The rehabilitation apparatus of claim 12, further comprising an obstruction member disposed on the outer housing and adapted to be in mechanical communication with the inner bearing to control rotation thereof.

15. The rehabilitation apparatus of claim 14, wherein:

the obstruction member includes a locked orientation, in which the obstruction member is in mechanical communication with the inner bearing, thereby exerting a force on the inner bearing to prevent rotation thereof; and wherein the obstruction member includes an unlocked orientation, in which the obstruction member is not in mechanical communication with the inner bearing, such that an obstruction force is not exerted on the inner bearing, and such that the inner bearing can feely rotate with respect to the outer housing.

16. A rehabilitation apparatus comprising:

a proximal end opposite a distal end, with a proximal rigid member disposed at the proximal end, and a distal rigid member disposed at the distal end;

a drag chute spanning from the proximal end to the distal end, the drag chute being coupled to each of the proximal rigid member and the distal rigid member;

a support rod secured to each of the proximal rigid member and the distal rigid member, the support rod spanning along a longitudinal axis of the drag chute from the proximal end to the distal end of the rehabilitation apparatus;

a proximal coupling element coupled to the support rod and disposed adjacent to the proximal rigid member, the proximal coupling element defining an aperture through which a user's limb can be inserted, and including a strap disposed thereon, the strap capable of being tightened against an object, such as the user's limb, to secure the object to the rehabilitation apparatus;

a distal coupling element coupled to the support rod and disposed between the proximal coupling element and the distal end of the rehabilitation apparatus, the distal coupling element including:

an outer housing defining an aperture;

an inner bearing rotatably coupled to the outer housing, the inner bearing including a handle at least partially extending from the outer housing toward the aperture, such that the user's limb can grasp the handle to rotate the inner bearing and/or swing the rehabilitation apparatus, and such that the drag chute provides resistance when the rehabilitation apparatus travels through air during a rehabilitation exercise; and an obstruction member disposed on the outer housing and adapted to be in mechanical communication with the inner bearing to control rotation thereof, the obstruction member including:

a locked orientation, in which the obstruction member is in mechanical communication with the inner bearing, thereby exerting a force on the inner bearing to prevent rotation thereof; and an unlocked orientation, in which the obstruction member is not in mechanical communication with the inner bearing, such that an obstruction force is not exerted on the inner bearing, and such that the inner bearing can feely rotate with respect to the outer housing; and a locking mechanism in communication with the distal coupling element and the support rod, the locking mechanism having a locked orientation and an unlocked orientation, in which in the locked orientation, the locking mechanism exerts pressure on the distal coupling element to secure the distal coupling element to the support rod, and in which the unlocked orientation, the locking mechanism reduces pressure exerted on the distal coupling element, such that the distal coupling element can slidably translate with respect to the support rod.

17. The rehabilitation apparatus of claim 16, further comprising snap buttons at a distal end of the drag chute and a proximal end of the drag chute, such that the snap buttons couple the drag chute to the proximal and distal rigid members.

* * * * *